US005300749A

United States Patent [19]

Kotikangas

[11] Patent Number: 5,300,749

[45] Date of Patent: Apr. 5, 1994

[54] METHOD AND APPARATUS FOR THE REDUCTION OF DISTANCE-DEPENDENT VOLTAGE INCREASE OF PARALLEL HIGH-FREQUENCY ELECTRODES

[75] Inventor: Kauko Kotikangas, Helsinki, Finland

[73] Assignee: Imatran Voima Oy, Helsinki, Finland

[21] Appl. No.: 952,529

[22] PCT Filed: Apr. 13, 1992

[86] PCT No.: PCT/FI92/00112

§ 371 Date: Dec. 9, 1992

§ 102(e) Date: Dec. 9, 1992

[87] PCT Pub. No.: WO92/19082

PCT Pub. Date: Oct. 29, 1992

[30] Foreign Application Priority Data

Apr. 15, 1991 [FI] Finland ..... 911816

[51] Int. Cl.[5] ..... H05B 6/54

[52] U.S. Cl. ..... 219/779; 219/773

[58] Field of Search ..... 219/10.81, 10.75, 10.77, 219/10.41

[56] References Cited

U.S. PATENT DOCUMENTS

| | | | |
|---|---|---|---|
| 2,871,332 | 1/1959 | Northmore et al. | 219/10.69 |
| 3,329,797 | 7/1967 | McDougall Clark | 219/10.81 |
| 3,461,263 | 8/1969 | Manwaring | 219/10.81 |
| 3,701,875 | 10/1972 | Witsey et al. | 219/10.81 |
| 4,670,634 | 6/1987 | Bridges et al. | 219/10.41 |

FOREIGN PATENT DOCUMENTS

| | | |
|---|---|---|
| 1303768 | 5/1926 | Fed. Rep. of Germany . |
| 1565005 | 2/1970 | Fed. Rep. of Germany . |
| 55922 | 6/1979 | Finland . |
| WO87/05437 | 9/1987 | PCT Int'l Appl. . |

*Primary Examiner*—Philip H. Leung
*Attorney, Agent, or Firm*—Pollock, Vande Sande & Priddy

[57] ABSTRACT

The invention concerns a method and equipment for the compensation of voltage increase in electrodes of a apparatus used to process dielectric materials. In the apparatus the electrodes are arranged parallel, at a constant distance from each other across the conveying path of the material to be treated. Electric power to the electrodes is supplied by connecting the adjacent electrodes to a opposite pole of a high frequency power source. In order to minimize the voltage increase in the electrodes, a reverse magnetic field is brought to influence with the magnetic field of each electrode, by arranging a return path for the electrode current at a suitable distance from the electrode and connecting these return paths to the return paths of the adjacent electrodes.

15 Claims, 3 Drawing Sheets

METHOD AND APPARATUS FOR THE REDUCTION OF DISTANCE-DEPENDENT VOLTAGE INCREASE OF PARALLEL HIGH-FREQUENCY ELECTRODES

The present invention is a method and an apparatus for reducing distance-dependent voltage increase of electrodes occurring in an apparatus comprising parallel, rod-like electrodes connected to a high-frequency voltage source.

Electrode structures of this type are used, for example, in heating and/or drying of various material webs, sheets or layers with high-frequency energy. The material to be treated in said machines is passed close to the rod-like electrodes, several of which are placed in parallel essentially transversely with respect to the travel direction of the material.

The parallel electrodes are alternately connected to the high-frequency power supply for the purpose of forming an electromagnetic field between the electrodes to be directed to primarily influence the material to be treated. If the material to be treated contains moisture or otherwise possesses similar dielectric properties, the high-frequency electromagnetic field that is formed between two electrodes mainly is directed to the material to be treated. If the material also has a high dielectric loss factor, the high-frequency field generates a heating effect in the material, which, in turn, results in the desired heating and/or drying of the material.

Examples of applications for apparatuses of this type are heating of paper web, wood veneer or textile materials with the aim of drying the material or equalizing their moisture content, heating of layers with which the material are coated or which are absorbed in it, after-treatment of bakery products proceeding on a transport conveyor, heating of a powdery or grainy stuff layer proceeding on a conveyor, etc.

In most applications, the material to be treated passes as a wide web or mat, across which the electrodes must reach in order to bring about the desired effect. Long electrodes are involved with the well known problem of standing waves increasing the voltage with increasing distance from the voltage supply point. In many applications, size restrictions of the apparatus and similar structural factors enable voltage supply to the electrodes only from one end, at the most from both ends of the electrode, thus limiting the possibilities to eliminate the voltage increase.

As is well-known, the above structures have provided a solution for the reduction of voltage increase, in which inductive coils are connected between adjacent electrodes at fixed intervals. This arrangement provides a serviceable solution for the reduction of voltage increases, in case it is applicable as far as the other apparatus structure is concerned. In paper and wood veneer dryer, for instance, in which some 5-meter electrodes and an alternating voltage frequency of 13.56 MHz are used, the solution is capable of keeping the voltage within the range of ±5% of the initial voltage (1.5 kV) along the entire electrode. The solution requires two inductive coil connections along the rods.

The above known technology, based on the use of so-called centralized compensating coils, suffers, however, from certain problems in a system containing several parallel electrodes. The structure is unfavourable in terms of space need. It is also prone to getting dirty, and is difficult to clean. Inaccuracy in dimensioning of the apparatus, caused by the mutual inductances of the compensating coils further presents a functional problem. A solution for the elimination of the voltage increase occurring in the electrodes, based on a different principle, has been introduced in the Finnish patent specification 55922. In this solution, the electrodes are combined into groups of two electrodes, and a common supply is used by having a supply conductor located between the electrodes at an equal distance from them. Supply points are favourably chosen at several points between the ends of the electrodes. By taking the frequency of the alternating voltage properly into account when choosing the supply points, a compensating effect to the voltage in the electrodes can be achieved. Compensating of the electrode voltage is also influenced by the fact that the current of the supply cable and the current of the electrode at a part of the electrode are opposite, and consequently the resulting induced magnetic fields are also opposite and partly effect in the compensating of the voltage occurring in the electrode.

The effect of the, known apparatus can be substantially achieved in desired form only when current is supplied to both ends of the conductor located between the electrodes. Although the apparatus was specifically developed to reduce problems occurring in long electrodes (electrode length smaller than approximately one fifth of the used wavelength), said current supply inevitably causes problems with such electrodes. Either each has its own generator to be used for both supply ends, one at each side of the apparatus, or the other supply end is to be equipped with long conductors. Two separate generators tend to cause problems, the most crucial of which in terms of operation is synchronization of the generators. On the other hand, the use of long conductors may add to the problem of voltage increase, that originally was to be solved. In this known structure, however, the number of connection points between the supply conductors and the electrodes according to the operating principle of the apparatus is restricted. If current is supplied at both ends of the supply conductor, the supply points are limited to two additional points over the length of the electrodes. If current is supplied to one end of the supply conductor, current supply to the electrodes can only be reasonably implemented at one additional point along the electrode. The circumstances referred to above restrict the maximum length of the electrodes to no more than one fourth of the wavelength, as mentioned in the publication.

SUMMARY OF THE INVENTION

According to the basic idea of the invention, the same compensating effect of the opposite magnetic fields generated by the reverse currents in compensating of the electrode voltage is used as in publication FI 55922, although implemented in such a way that the restrictions characteristic of the system known from publication FI 55922 can be avoided. According to the basic idea of the invention this can be achieved so that a magnetic field opposite to the magnetic field of the electrode is generated by arranging a return path for the electrode current from the compensating point at a distance from the electrode ensuring the avoidance of any electric discharges, and reaching to the distance to be compensated, and by connecting this return path essentially at its end with the corresponding return path of each adjacent electrode possessing an opposite potential.

The special forms of implementation of the method according to the invention are shown in the enclosed dependent claims.

The apparatus implementing the method according to the invention, is characterized by a compensating conductor arranged in the vicinity of each electrode, the conductor passing at least at a distance from the electrode ensuring the avoidance of any electric discharge, and reaching over a part of the length of the electrode. The compensating conductor is connected to the compensating point of the electrode at its end away from the current supply point of the electrode, and, at its other end, to the end of the corresponding compensating conductor of each adjacent electrode.

DESCRIPTION OF THE FIGURES

The invention is described based on the enclosed schematic drawing, in which.

DESCRIPTION OF THE PREFERRED EMBODIMENT

Figure 1:
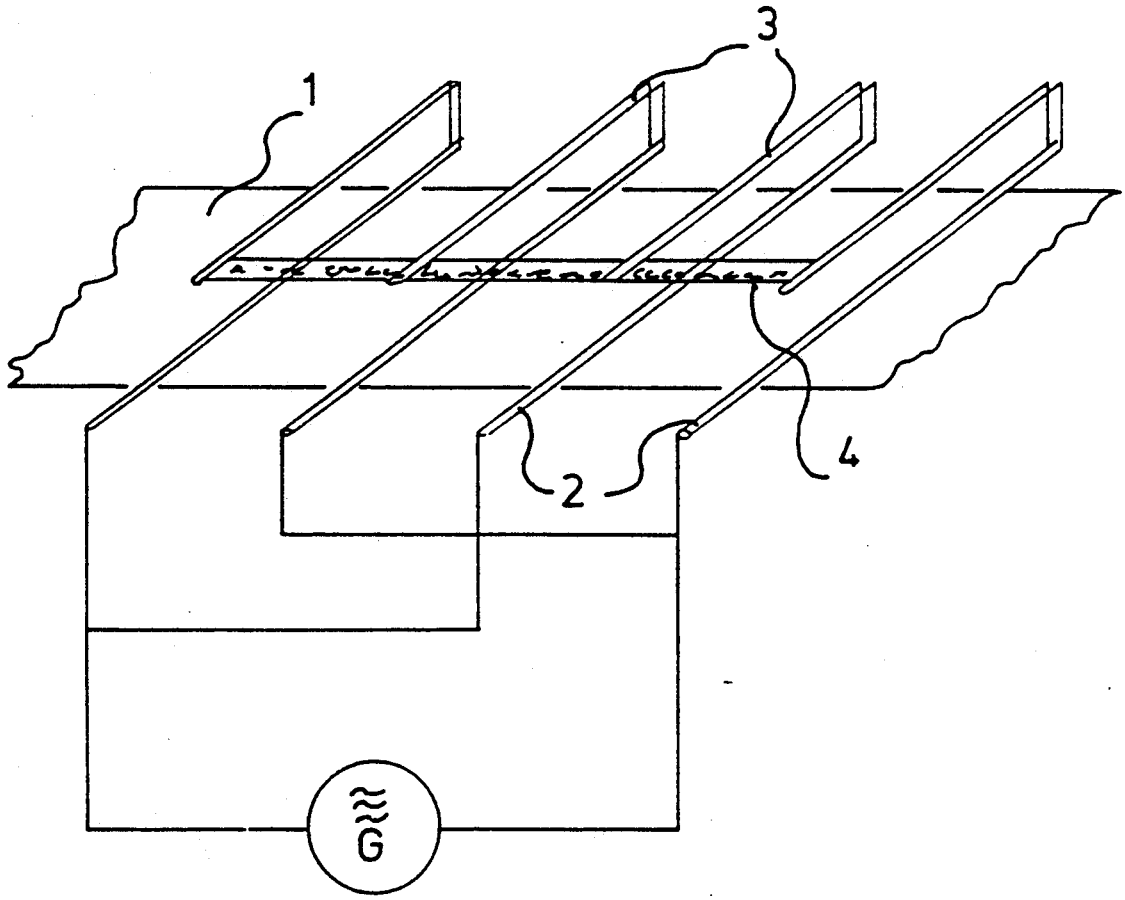
FIG. 1 illustrates a principal implementation of the method according to the invention for the heat treatment of web-like material.

FIG. 1 shows an apparatus intended for the heating treatment of material 1 passing as a continuous web. Material 1 can be, for instance, a paper web. The apparatus comprises electrodes 2 arranged to lie across the web and being alternately connected to the opposite potentials of the high-frequency power supply G. According to the invention, a conductor 3 is conducted from the opposite end of each electrode with respect to the power supply end, installed substantially parallel to the electrode. Conductor 3 is positioned at such a distance from its electrode 2 that the air gap that is formed guarantees a sufficient electric breakdown strength. Conductor 3 is stretched over a substantial part of the length of electrode 2, which in practice has proved to be at least two-thirds of the electrode length.

At the end range of the conductors, short-circuit elements 4 are arranged, by which the conductor can be connected to the corresponding conductor of the adjacent electrode. Conductor 3 of two adjacent electrodes and the short-circuit element 4 connecting them to each other form a compensating coil. The short-circuit elements can be displaced in longitudinal direction with respect to conductors 3 in order to adjust the compensating inductance to be accurate in each case.

Many factors must be considered when dimensioning an apparatus of said type to ensure that the desired end result is achieved. The first basic factor is the mutual distance of the electrode rods 2 in the travel direction or web direction of the material to be processed. The voltage to be supplied to the electrodes increases with growing distance. The increased supply voltage, in turn, influences the compensating inductances. When operating the apparatus on radio frequencies, the mutual distance of the electrodes may vary case by case from a few centimeters to tens of centimeters, for example, to dimensions of some 20–30 centimeters. A dimension of 10–15 centimeters can be considered a general value.

The distance of the inductance coil from the electrodes is primarily determined according to the electric breakdown strength. The distance can also be used to affect the compensating inductance; the greater the distance the inductance coil is located from the electrodes, the smaller the inductance effect is. This circumstance can be used for adjusting the compensation effect by varying the distance of the inductance conductors from the electrode at various points of the compensating range. A distance of some 20 centimeters can be considered the maximum distance between the electrode and the inductance conductor. The diameter of both the electrode and the inductance conductor also has its own effect on the dimensioning of the apparatus. The minimum diameter is determined by the heating caused by the current to be conducted. A diameter of some 10–40 mm can be considered conventional, although dimensions even up to some 100 mm occur.

As distinct from the basic implementation form presented in the drawing figures, the electrode rods may also be connected over an inductance or a capacitance to the adjacent rod at the opposite end with respect to the current supply end in order to bring about a phase displacement between the rods. When using long electrodes, the arrangement can be applied in which compensating points are located in sequence over the length of several electrodes 2.

Figure 2:
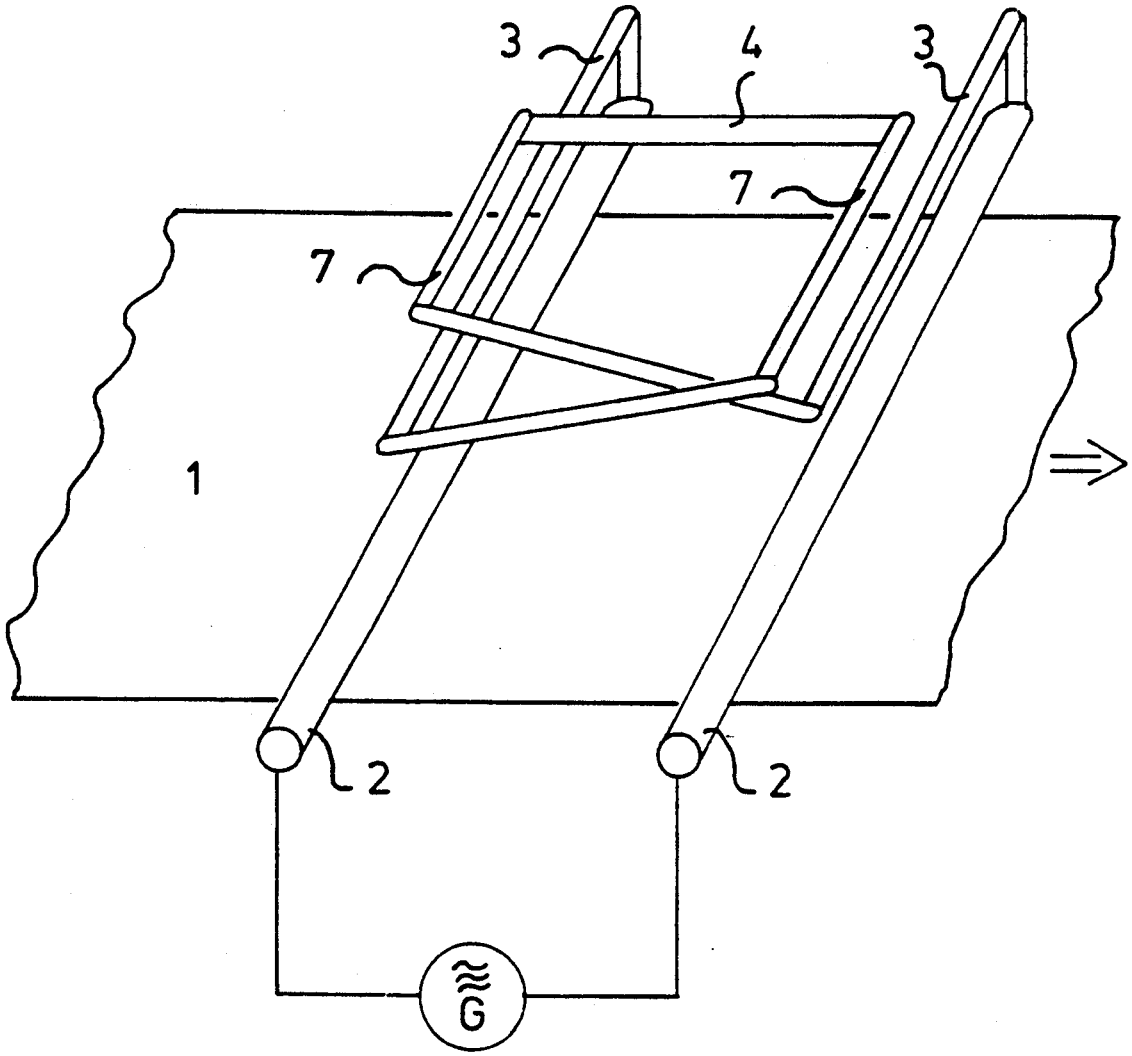
FIG. 2 illustrates a modification of the method.

In the implementation of FIG. 2, for the sake of simplicity two parallel electrodes 2 and the compensating inductance coil generated for them are illustrated. In compliance with the solution of FIG. 1, the compensating inductance coil is formed by conductor 3 connected to the electrode at the compensating point, which is conducted at least at the distance of said electric breakdown strength from the electrode. To add the compensating inductance to the coil, the adjacent coil conductors 3 are connected to each other by an additional coil 7, which is equipped with a short-circuit element 4 provided for the adjustment of inductance at its end.

When dimensioning the compensating inductance coil of the voltage increase, the so-called transmission line theory can be applied as a numerical basis, by which, based on given simplifying assumptions, approximative values may be determined for the inductances, and diameter of the inductance conductors and distance from the electrode, if the approximative length according to the two-wire calculation model is known. When defining the length, the inductance reducing effect of the inductance coil on the electrode inductance must be considered, which, in addition to other uncertainty factors, results in the need of adding some 10–20% to the calculated length of the inductance coil. The final adjustment of the inductance is carried out by experiments on the displacement of the short-circuit element 4.

In the following paragraph, a tangible dimensioning example is presented to illustrate the above.

A stray-field electrode system is given, with which a 4-meter wide, thin material web, e.g. paper web is heated by using the current supply frequency of 13.56 MHz. Diameters of the electrodes are 50 mm and their mutual distance is 200 mm. The voltage value is assumed to be 5 kV. The required air gap between the inductance conductor and the electrode thus is 50 mm (1 kV/cm). A diameter of 15 mm is chosen for the conductors of the compensating inductances in order to keep the heat development in the conductors under control. The dimension of 3.5 m of the loop, parallel to the electrode, is numerically achieved. To this dimension, an adjusting margin of some 10% is to be added, and thus it can be established that the coil reaches over some 95% of the electrode length.

Figure 3:
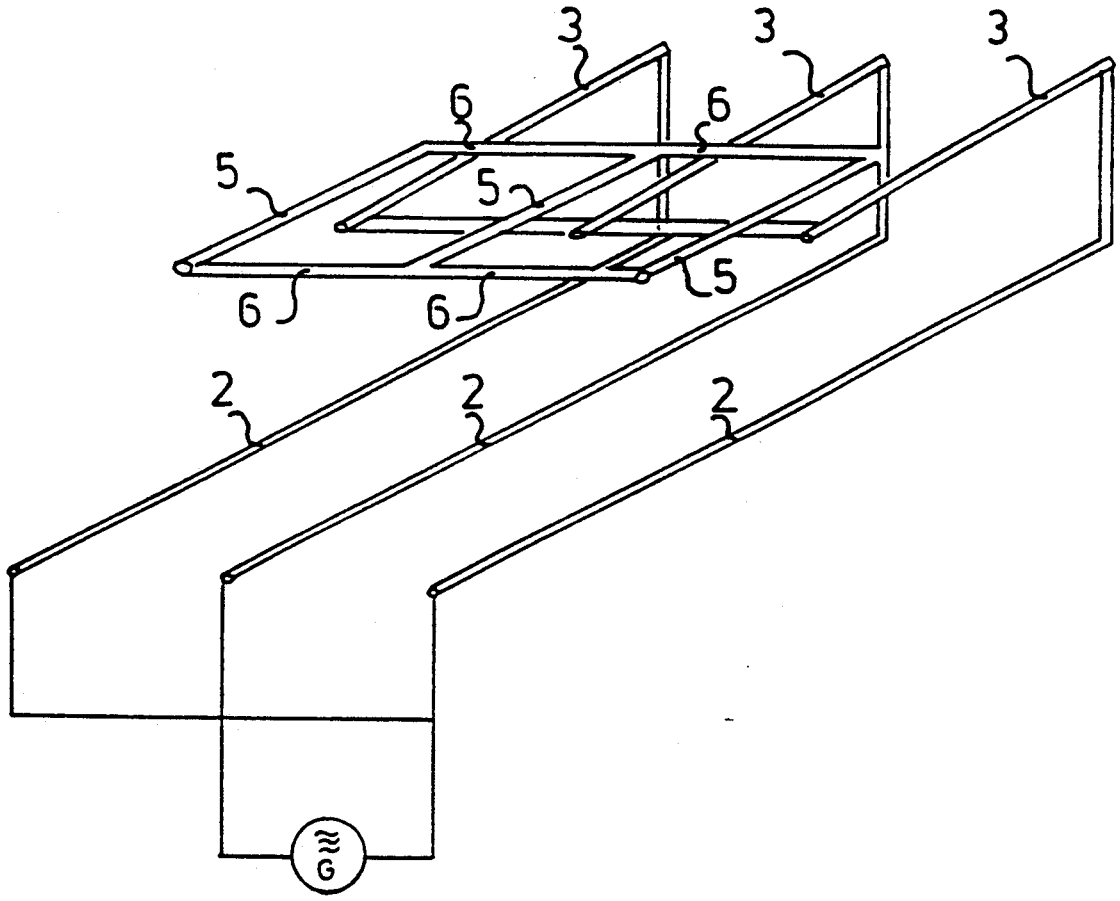
FIG. 3 shows a modification of the adjustment of the compensating coil.

As distinct from the above adjustment of the compensating inductances based on varying of the location of the short-circuit elements 4, FIG. 3 shows an implementation alternative to this adjustment. In the range of the end of each conductor 3, a short-circuited inductance coil is located, which is arranged to be adjusted in the longitudinal direction of conductors 3 at its position. By this adjustment at position, the magnitude of the compensating inductance may be influenced.

I claim:

1. A method of compensating voltage increases in a dielectric material processing apparatus having at least two rod-like parallel electrodes connected to opposite ends of a source of radio frequency signals comprising:

forming a return path conductor for each parallel electrode which is connected to the free end of the electrode corresponding to a compensation point and extends parallel to a respective electrode, terminating at a predetermined distance from its connection to said electrode, spaced from said electrodes a distance to avoid electric discharges with said electrodes; and, connecting each free end of each return path conductor to a free end of a return path conductor of an adjacent electrode, wherein a magnetic field a respective connected electrode.

2. Method according to claim 1, the characterized in that several compensating points are arranged along the electrode.

3. Method according to claim 2, characterized in that one return path conductor per electrode is arranged at each compensating point.

4. Method according to claim 2, characterized in that several return path conductors per electrode are arranged at each compensating point.

5. Method according to claim 2, characterized in that one return path per electrode is arranged at each compensating point.

6. Method according to claim 2, characterized in that several return conductors per electrode are arranged at each compensating point.

7. Method according to claim 1, characterized in that the return path conductors are guided at varying distances from the electrodes.

8. Method according to claim 1, further comprising adjusting a compensating inductance formed by two adjacent return paths, by using a closed inductance coil, positioned in the longitudinal direction with respect to the electrode, and which is located at an equal distance above or below the return conductor.

9. In combination with a dielectric material processing apparatus having a plurality of parallel electrodes excited at one end by a source of radio frequency signals, an equipment for compensating voltage increases comprising:

a plurality of compensating conductors, each compensating conductor connected to a free end of each parallel electrode corresponding to a compensation point and extending toward said excited end, said parallel electrodes and compensating conductors being spaced apart to avoid electrical discharges; and, means connecting adjacent free ends of said compensating conductors, whereby a magnetic field is generated for cancelling magnetic fields generated by said parallel electrodes.

10. Equipment according to claim 9, wherein, there are two or more compensating conductors in sequence along each electrode, and that each of the conductors is connected to its own sequential compensating point of the electrode.

11. Equipment according to claim 10, characterized in that the mutual connection point of the ends of the compensating conductors of the adjacent electrodes are adjustable along the length of the compensating conductors.

12. Equipment according to claim 10, characterized in that the compensating conductors of two adjacent electrodes are connected to each other with interconnected conductors to provide an inductive influence with the adjacent compensating conductor.

13. Equipment according to claim 9, wherein the means connecting the free ends of the compensating conductors of the adjacent electrodes are adjustable along the length of the compensating conductors.

14. Equipment according to claim 9, characterized in that the compensating conductors of two adjacent electrodes are connected to each other with interconnected conductors guided in induction influence with the adjacent compensating conductor.

15. Equipment according to claim 9, wherein an inductance adjustment apparatus is located at the mutual connection point of the compensating conductors of the electrodes, which comprises rods that are parallel to the compensating conductors and located at the same mutual distance, and conductors connecting the rods at their ends.

* * * * *

UNITED STATES PATENT AND TRADEMARK OFFICE

CERTIFICATE OF CORRECTION

PATENT NO. : 5,300,749

DATED : April 5, 1994

INVENTOR(S) : Kotikangas

It is certified that error appears in the above-indentified patent and that said Letters Patent is hereby corrected as shown below:

In column 5, claim 1, line 27, after "field" insert

--is generated by each return path which cancels a magnetic field generated by --.

Signed and Sealed this

Thirtieth Day of May, 1995

*Attest:*

Bruce Lehman

BRUCE LEHMAN

*Attesting Officer*

*Commissioner of Patents and Trademarks*